US005592809A

United States Patent [19]

Marcotrigiano et al.

[11] Patent Number: 5,592,809

[45] Date of Patent: Jan. 14, 1997

[54] LINK FORMING AND JOINING APPARATUS

[75] Inventors: Anthony Marcotrigiano, Rumford; James T. Pepper, Coventry, both of R.I.

[73] Assignee: Crafford Precision Products Co., Riverside, R.I.

[21] Appl. No.: 389,134

[22] Filed: Feb. 14, 1995

[51] Int. Cl.[6] ..... B21L 1/02

[52] U.S. Cl. ..... 59/25; 59/16; 59/24; 59/27

[58] Field of Search ..... 59/16, 23, 24, 59/25, 27

[56] References Cited

U.S. PATENT DOCUMENTS

| | | | |
|---|---|---|---|
| 1,478,808 | 12/1923 | Weber | 59/18 |
| 1,478,814 | 12/1923 | Bittrolf | 59/18 |
| 2,680,344 | 6/1954 | Capellazzi et al. | 59/27 |
| 2,713,765 | 7/1955 | Capellazzi et al. | 59/27 |
| 3,004,383 | 10/1961 | Crafford | 59/25 |
| 3,354,633 | 11/1967 | Crafford | 59/24 |
| 3,841,088 | 10/1974 | Crafford et al. | 59/16 |
| 5,412,933 | 5/1995 | Mallett et al. | 59/27 |

*Primary Examiner*—David Jones
*Attorney, Agent, or Firm*—Salter & Michaelson

[57] ABSTRACT

Apparatus is disclosed for forming a single wire link which can be joined to a preformed jewelry article. The apparatus includes an electric motor-driven cam assembly that provides for sequential operation of the wire feeding and link forming devices. A single wire section is severed from a wire stock, bent into a U-shaped configuration and fed to a link forming station within a common working plane where the U-shaped wire element can be formed into a link and joined to a jewelry article. The link forming apparatus avoids the use of a magazine for storing a plurality of U-shaped wire element thus eliminating unused U-shaped wire elements in the magazine when switching wire stock. The apparatus is constructed in a manner which readily permits quick and easy changing of the feeding and forming dies when switching to different size wire stock. The apparatus further provides a simple adjustment mechanism for adjusting the length of the wire section severed from the wire stock.

5 Claims, 16 Drawing Sheets

LINK FORMING AND JOINING APPARATUS

BACKGROUND AND SUMMARY OF THE INVENTION

The instant invention relates to link forming apparatus having particular application in the jewelry industry wherein the links as formed are joined to preformed jewelry articles, such as chains and findings.

Link forming and joining devices have heretofore been known in the art. In this regard, the U.S. Patent to Crafford et al, U.S. Pat. No. 3,841,088 represents the closest prior art to the subject invention of which the applicant is aware. The Crafford patent discloses a link forming and joining device wherein the device is operable by a set of cams for automatically feeding wire stock to a cutting and forming station at which the wire stock is severed into a plurality of wire sections, the wire sections being bent into a "U" configuration, and stored in a magazine, and then being individually transferred from the magazine to a forming station for joining to a preformed jewelry article, such as a chain for finding. More specifically, the wire sections are severed and bent into a U-shaped configuration at one station and then transferred into a magazine which is operative for storing as many as 100 to 150 U-shaped wire elements for use. The front end of the magazine communicates directly with a guide assembly having a vertical guide passage. The guide assembly locates the wire elements in oriented position for vertical movement through the guide passage to a forming station located at the top of the guide assembly. A lower forming tool is located in the passage of the guide assembly and is operated in timed relation by a cam to lift an individual U-shaped wire element to the forming station. Another cam is operable for simultaneously drawing a forming head die downwardly toward the guide assembly, the forming head die cooperating with the lower forming tool to form, the U-shaped wire element into a completed link, or ring, thereby joining the link to a preformed jewelry article, such as a chain or finding.

While the link forming and joining apparatus as described above has satisfactorily served its intended purpose, its operation has several drawbacks related to a need to be able to quickly and easily change from using one size wire stock to another size wire stock. Small jewelry manufactures often produce jewelry articles in batches of as few as fifty pieces, each different type of article usually requiring a different size wire stock for joining to a chain, etc. Since each size wire stock requires a corresponding set of cutting, bending and forming dies, each time a manufacturer switches to production of a new article, and a new size wire stock, the cutting, bending and forming dies must be removed and replaced with the desired sizes. Manufacturers have found it very difficult to quickly change such dies in the prior art apparatus.

Another drawback related to changing wire stock sizes has been difficulty in adjusting the length of wire section being fed into the cutting station after a new size wire stock is installed. The length of the wire section severed from the wire stock is critically important in assuring that the link is properly formed and joined, too little wire resulting in a partially open link, too much wire resulting in a deformed shape due to excess material in the die.

Yet another drawback has been the use of a magazine for storage of a plurality of preformed U-shaped wire elements prior to use. The wire stock used to form the links is primarily precious metal wire stock, such as gold or silver wire. Since manufactures often run small batches of as few as fifty jewelry articles, each time a manufacturer switches to a different size or type of precious metal stock, there are approximately 100 to 150 unused U-shaped wire elements still left in the magazine. Since the wire elements are precious metal and cannot be reinserted into the magazine after removal, the manufacturer usually saves and recycles the unused pieces. However, the waste and extra expense from this arrangement is problematic for some manufacturers.

The instant invention provides a link forming and joining apparatus which overcomes the drawbacks of the prior art device. The instant link forming and joining apparatus comprises a guide assembly including a vertically extending guide passage therein, the passage having a lower end for receiving a U-shaped wire element therein with an open end of said U-shaped wire element facing upwardly. The passage further has an upper end defining a forming station, the passage defining a vertical working plane. The apparatus further comprises a lower forming tool mounted for sliding movement in the passage for engaging a U-shaped wire element in the passage and lifting the U-shaped wire element from the lower end of the passage to the forming station at the upper end. A forming head assembly is located above the guide assembly, wherein the head assembly includes a forming head die mounted for vertical movement within the working plane for engaging a U-shaped wire element situated at the forming station during a forming operation. More specifically, the forming head die cooperates with the lower forming tool to close the open end of the U-shaped wire element during the forming operation. In use, a link of a chain and a link of a jewelry finding are placed over the upwardly extending arms of the U-shaped wire element prior to forming. When the forming operation is performed, the link is closed to join the chain to the finding. The apparatus still further comprises means for feeding wire stock to a cutting and bending station located within the working plane at the lower end of the passage, means at the cutting and bending station for severing a wire section from the wire stock, and means at the cutting and bending station for bending the wire section into a U-shaped wire element within the working plane. The feed mechanism, the severing device, the forming device, the lower forming tool and the forming head die are all operated in timed relation by a cam system for sequentially severing, bending and forming the U-shaped wire element in a single link forming operation.

The means for severing the wire section from the wire stock comprises a guide block having a terminal edge disposed adjacent to the cutting and bending station, and a vertically movable carriage having a pair spaced forming arms, one of the forming arms being disposed in closely spaced sliding relation with the terminal edge of the block. In operation, the forming arm engages the wire section extending from the guide block and severs the wire section from the wire stock when the carriage is moved upwardly.

The means for forming the wire section into a U-shaped wire element comprises a retractable arbor extending through the working plane at the cutting and bending station and further extending between the forming arms of the carriage. The terminal upper edges of the forming arms include a groove for holding a respective end of the severed wire section. The forming carriage is operative for lifting the severed wire section upwardly into engagement with the arbor wherein the forming arms bend the respective ends of said wire section upwardly around the arbor to form a U-shaped wire element.

The means for feeding the wire stock to the cutting and bending station comprises a feed block assembly and a feed clamp assembly mounted on the feed block assembly. The feed block assembly comprises a body portion, and a horizontally extending guide bar mounted to the body portion, with the feed clamp assembly being slidably mounted on the guide bar for movement between first and second positions. The feed clamp assembly receives a length of wire stock therethrough and includes means for selectively clamping the wire stock. The feed block assembly further comprises a pivotably mounted lever having a first end pivotably mounted to the feed clamp assembly and a second end coupled to an actuator arm of the link forming apparatus, the actuator arm being movable for actuating the feed clamp assembly between the first and second positions. The lever includes a plurality of apertures therein for receiving a pivot pin attached to a pivot block slidably mounted in the body portion. The pivot pin defines a pivot axis of the lever and is selectively extended through one of the lever apertures to adjust the vertical position of the pivot axis. The pivot block is then slidably adjustable within the body portion by means of a threaded rod extending vertically through the pivot block for finite adjustment of the vertical position of the pivot axis. In operation, the adjustment of the vertical position of the pivot axis adjusts the horizontal travel of the feed clamp assembly thereby adjusting the length of the wire section fed into the cutting station.

Accordingly, among the objects of the instant invention are: the provision of a link forming and joining apparatus in which the die sets are easily removed and installed with minimum time and effort; the provision of a link forming apparatus including a simple adjustment mechanism for adjusting the travel length of the feeding mechanism; and the provision of a link forming and joining apparatus which performs a single wire section into a U-shaped configuration and individually transfers the wire element to a closure station without the use of a magazine.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
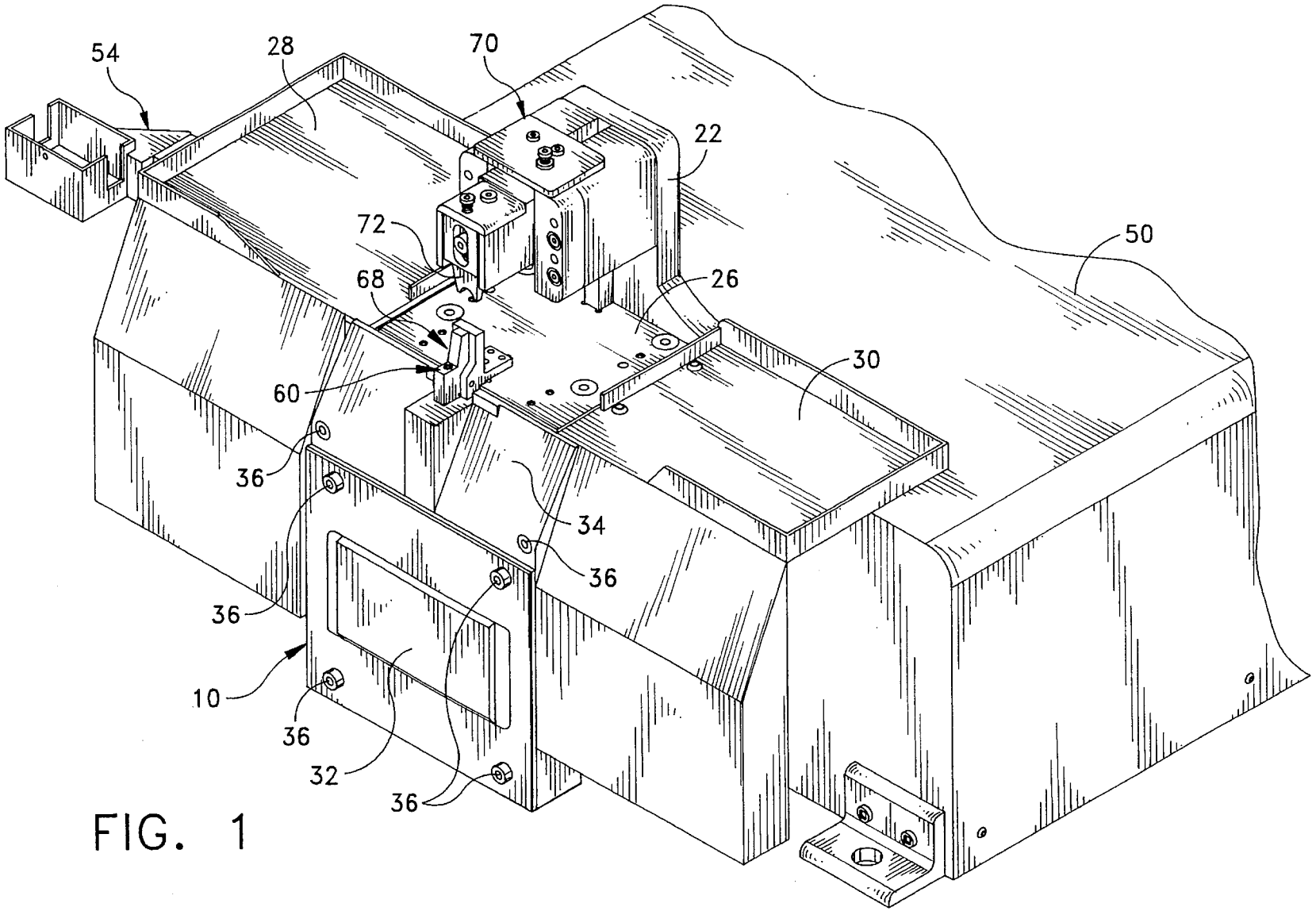
FIG. 1 is a perspective view of the link forming and joining apparatus of the instant invention.

Referring now to the drawings, the link forming and joining apparatus of the instant invention is illustrated and generally indicated at 10 in FIGS. 1–23.

Figure 2:
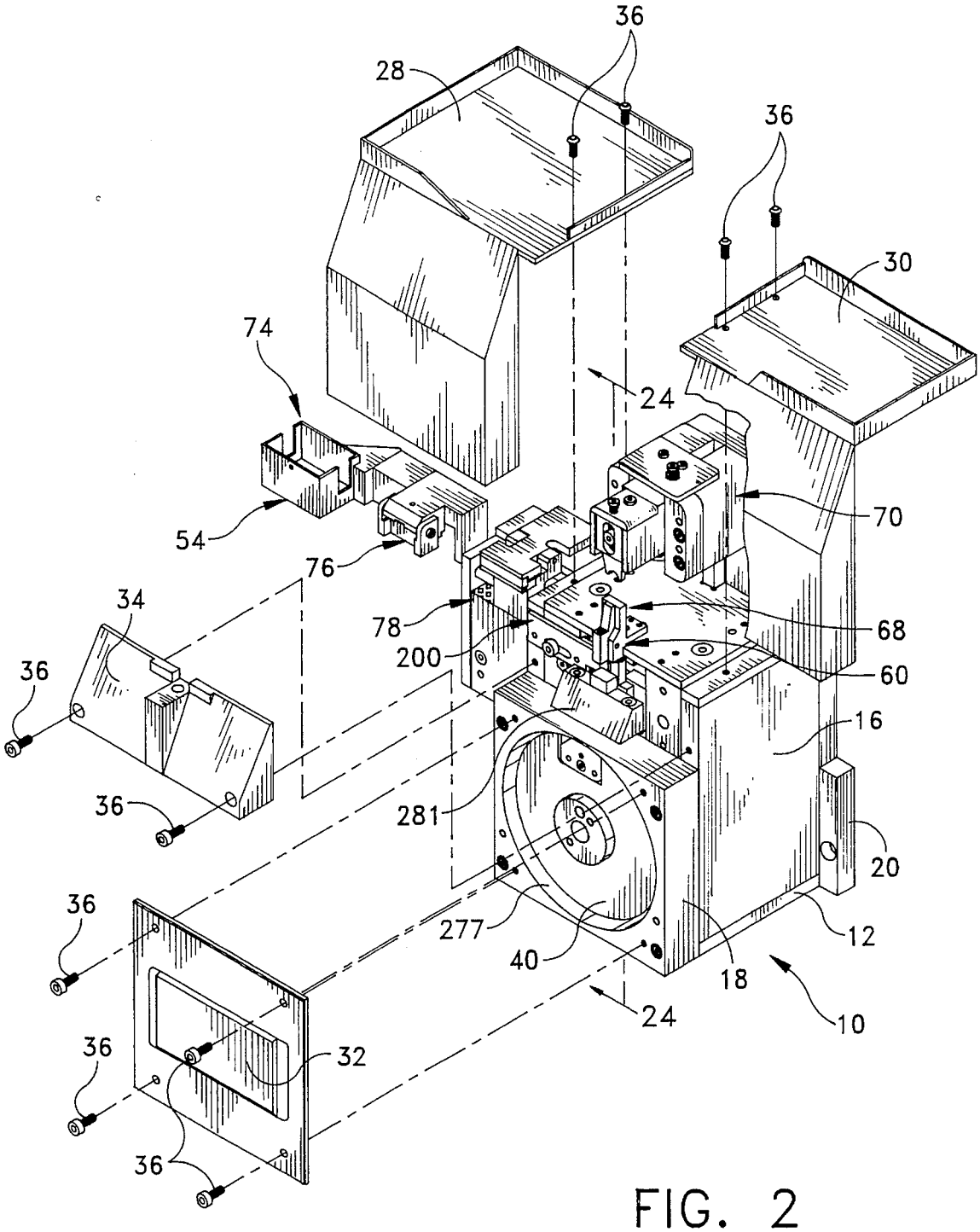
FIG. 2 is an exploded perspective view thereof showing assembly of the cover and tray plates.
Figure 3:
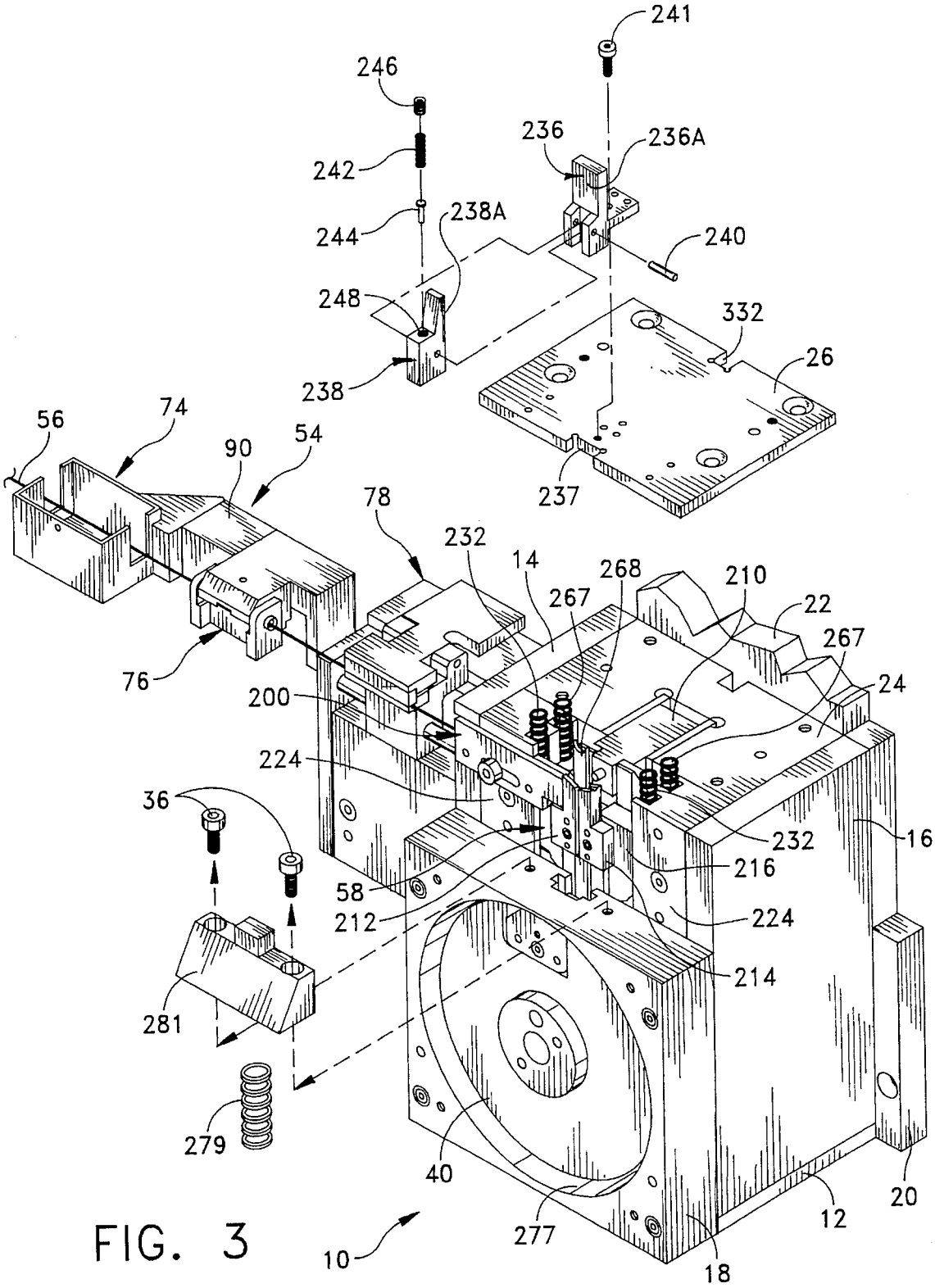
FIG. 3 is another exploded perspective view thereof showing assembly of the top housing plate and return spring cap.
Figure 4:
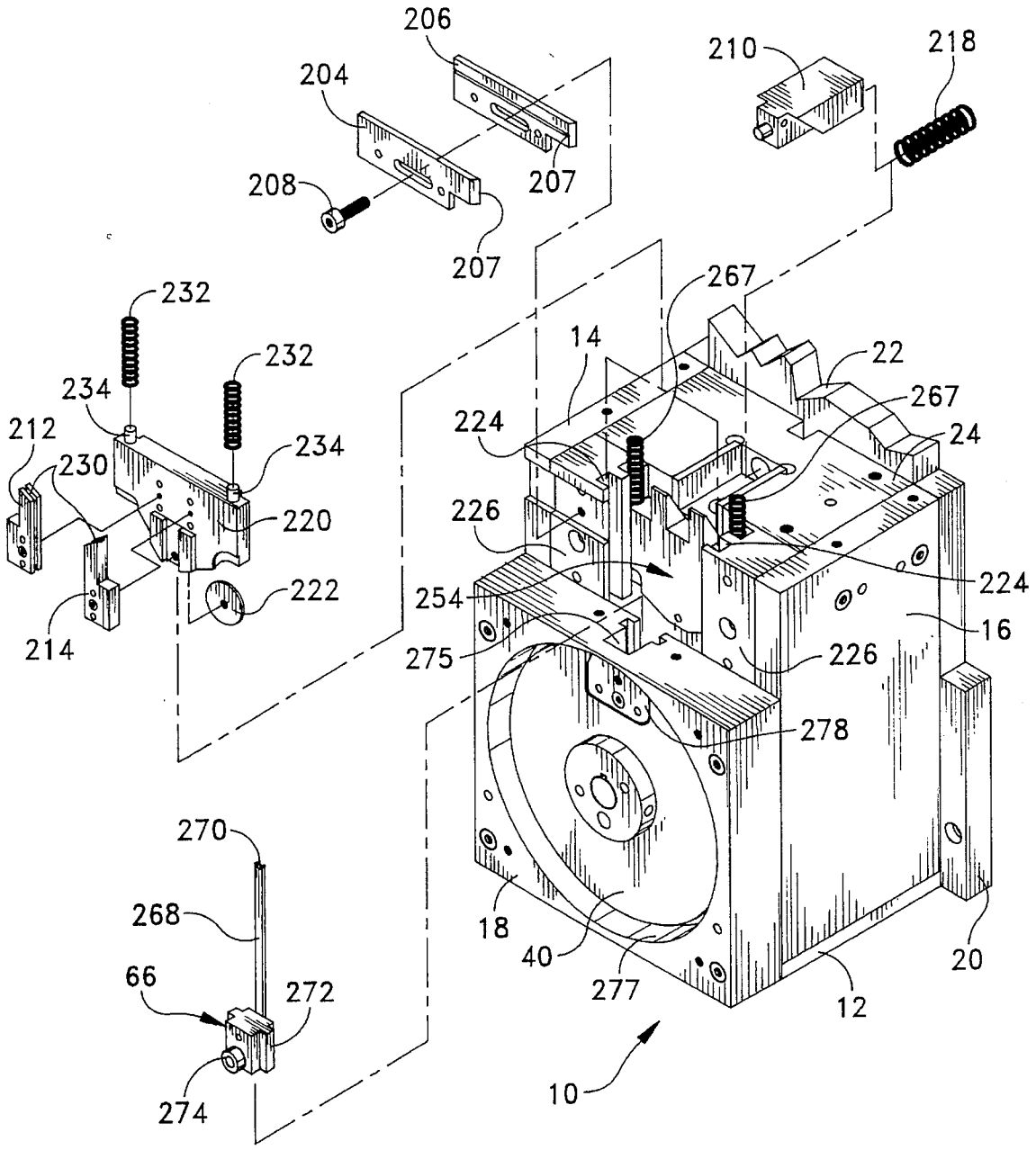
FIG. 4 is still another exploded perspective view thereof showing assembly of the guide block, the forming head die, the forming;carriage, and the lower forming tool.
Figure 5:
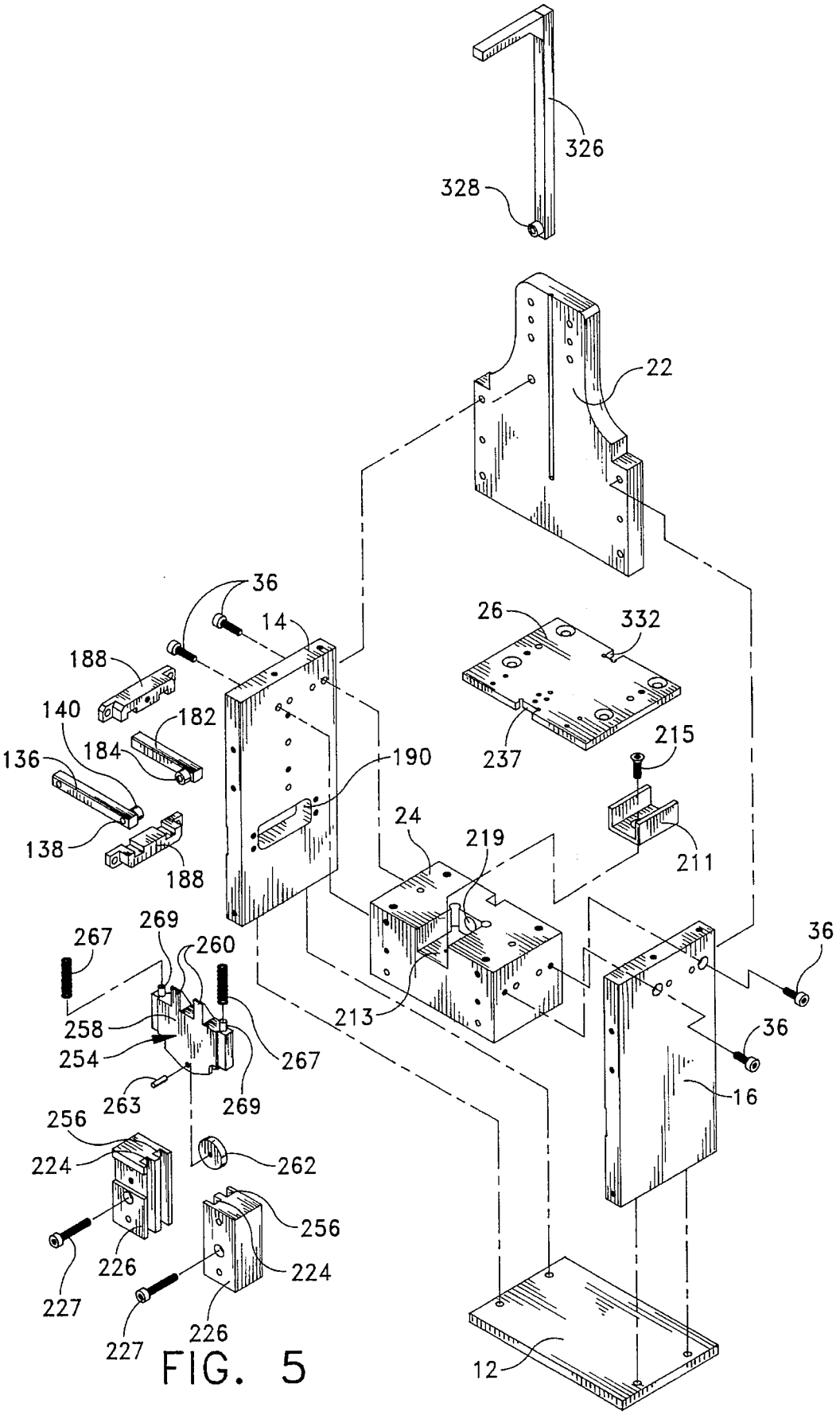
FIG. 5 is yet another exploded perspective view showing the assembly of the housing module, the feed assembly actuator arms, and the arbor retraction carriage.
Figure 6:
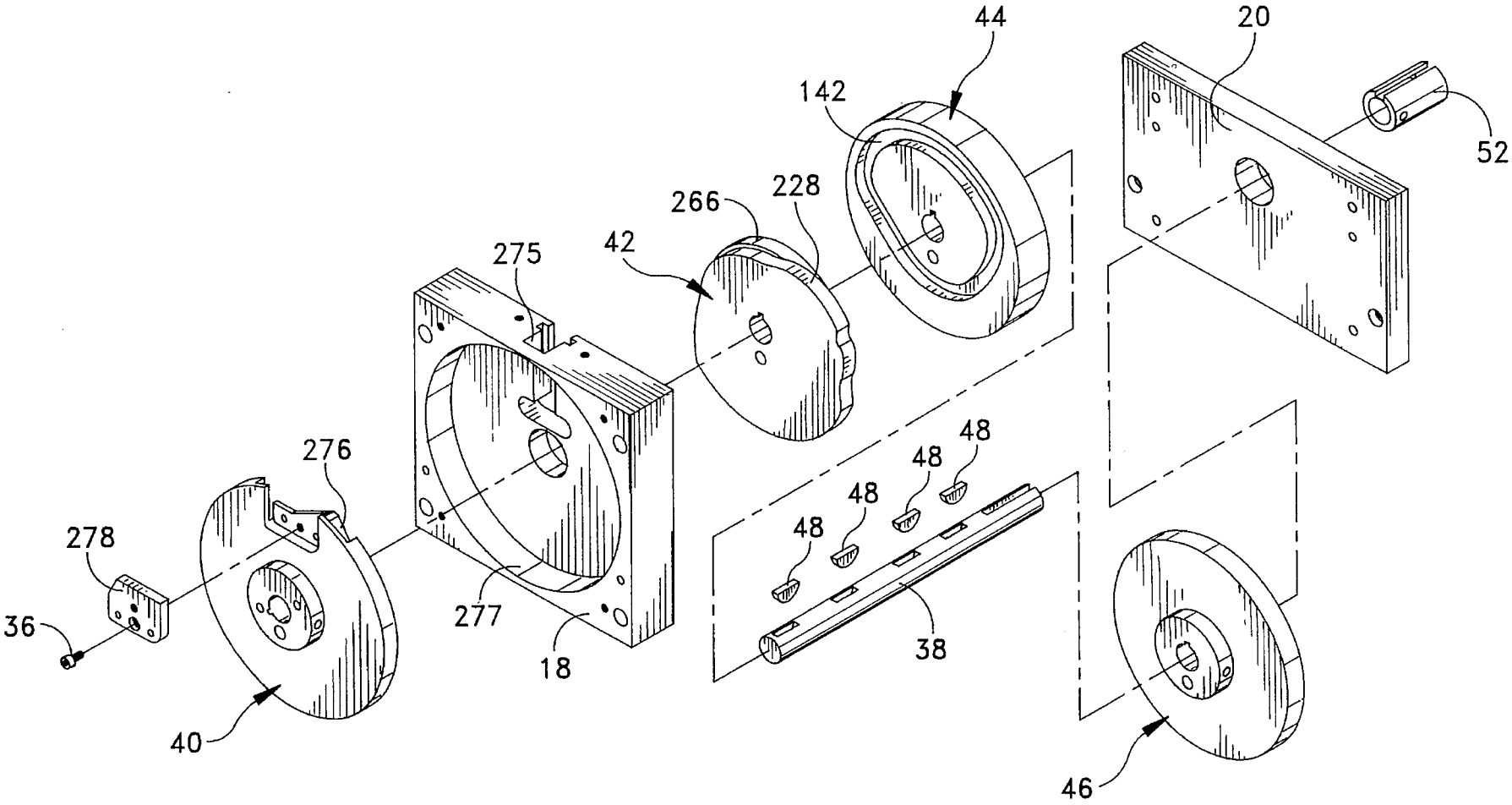
FIG. 6 is another exploded perspective view thereof showing the cam assembly.
Figure 7:
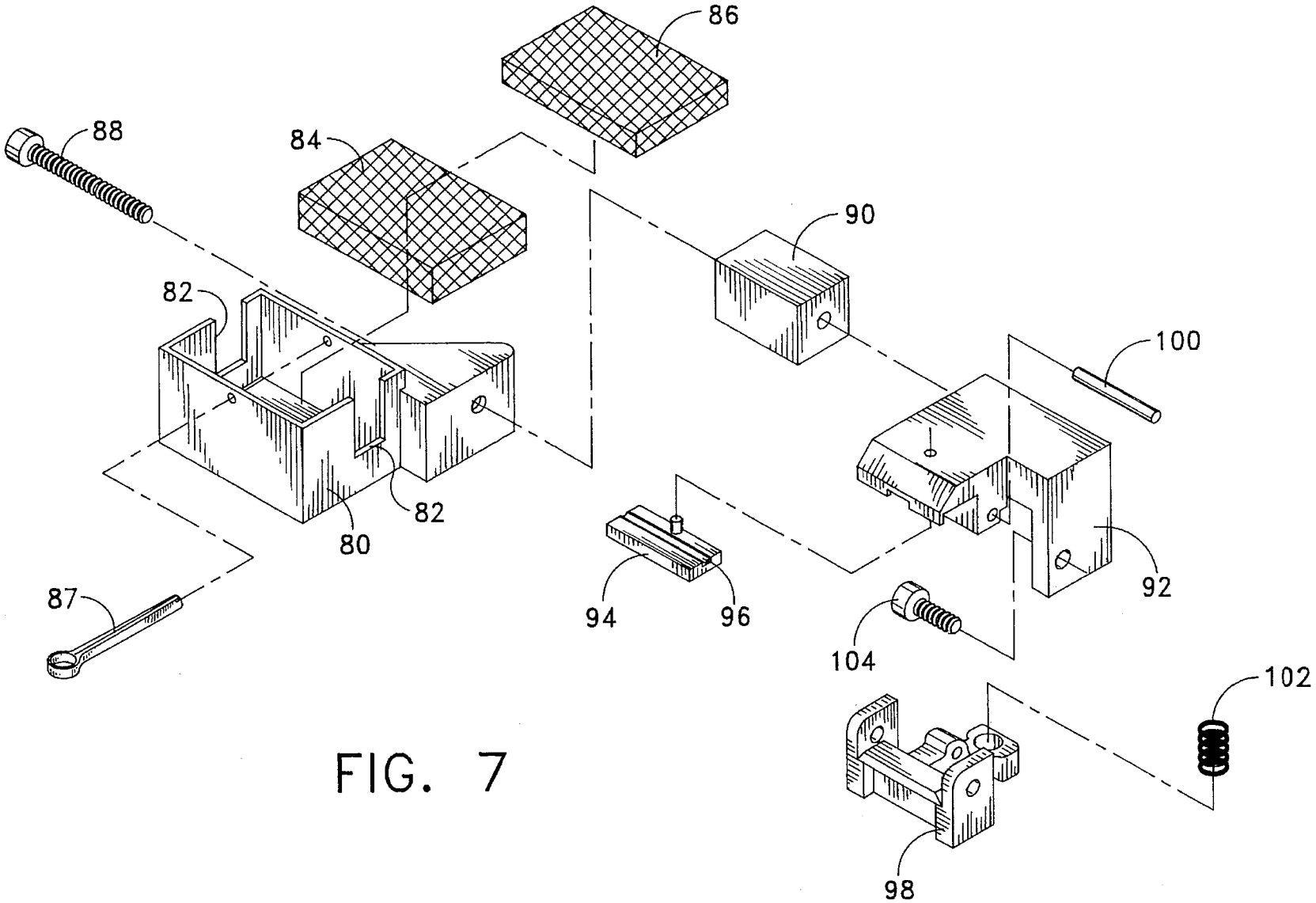
FIG. 7 is an exploded perspective view showing assembly of the wire guide and brake clamp apparatus.

Component parts of the apparatus 10 are mounted on a housing module including a bottom wall 12, left and right side walls 14, 16 respectively, front and rear supporting walls 18, 20 respectively, a head block support plate 22, a support block 24, and a top plate 26 (See FIGS. 5 and 6). Appropriate fasteners secures each of the components together. The housing module further includes left and right tray assemblies 28, 30 respectively, a front cover plate 32, and a tooling cover 34, each secured by appropriate threaded fasteners 36 (FIG. 2).

Referring to FIG. 6, the operation of the linking apparatus 10 is determined by a plurality of cams that are mounted on a cam shaft 38 that extends through and is supported by the front and rear walls 18, 20. More specifically, operation of the device 10 is controlled by four individual cams generally indicated at 40, 42, 44, and 46 respectively, which are keyed to the cam shaft 38 by key elements 48. Rotation of the cam shaft 38 and operation of the linking apparatus 10 is produced by a motor (not shown) that is mounted in an adjacent housing structure 50 (FIG. 1). The output shaft of the motor is interconnected to an electric clutch (not shown) of the single revolution type. The electric clutch, which is joined directly to the cam shaft 38 by a coupling 52, is operated by the motor, and is operable only to produce a single revolution of the cam shaft 38 for each forming operation, the operation of the clutch being controlled by a foot pedal (not shown) that is depressed by the operator.

In operation of the linking apparatus 10, a wire feed apparatus generally indicated at 54 (FIGS. 3, 7 and 8), feeds a continuous length of wire stock 56 to a cutting and bending station 58 located that the base of a guide assembly 60 at which a wire section 62 is severed from the wire stock 56 and formed into a U-shaped wire element 64. The U-shaped wire element 64 is then moved upwardly through a guide passage in the guide assembly 60 by a lower forming tool assembly 66 to a forming station 68. In a forming operation, it is necessary that a forming head assembly 70 in which a forming head die 72 is mounted, be moved downwardly to engage the open ends of the U-shaped wire element 64. As will be described hereinafter, each of the above devices and assemblies are sequentially operated in timed relation by cams 40, 42, 44 and 46.

Figure 8:
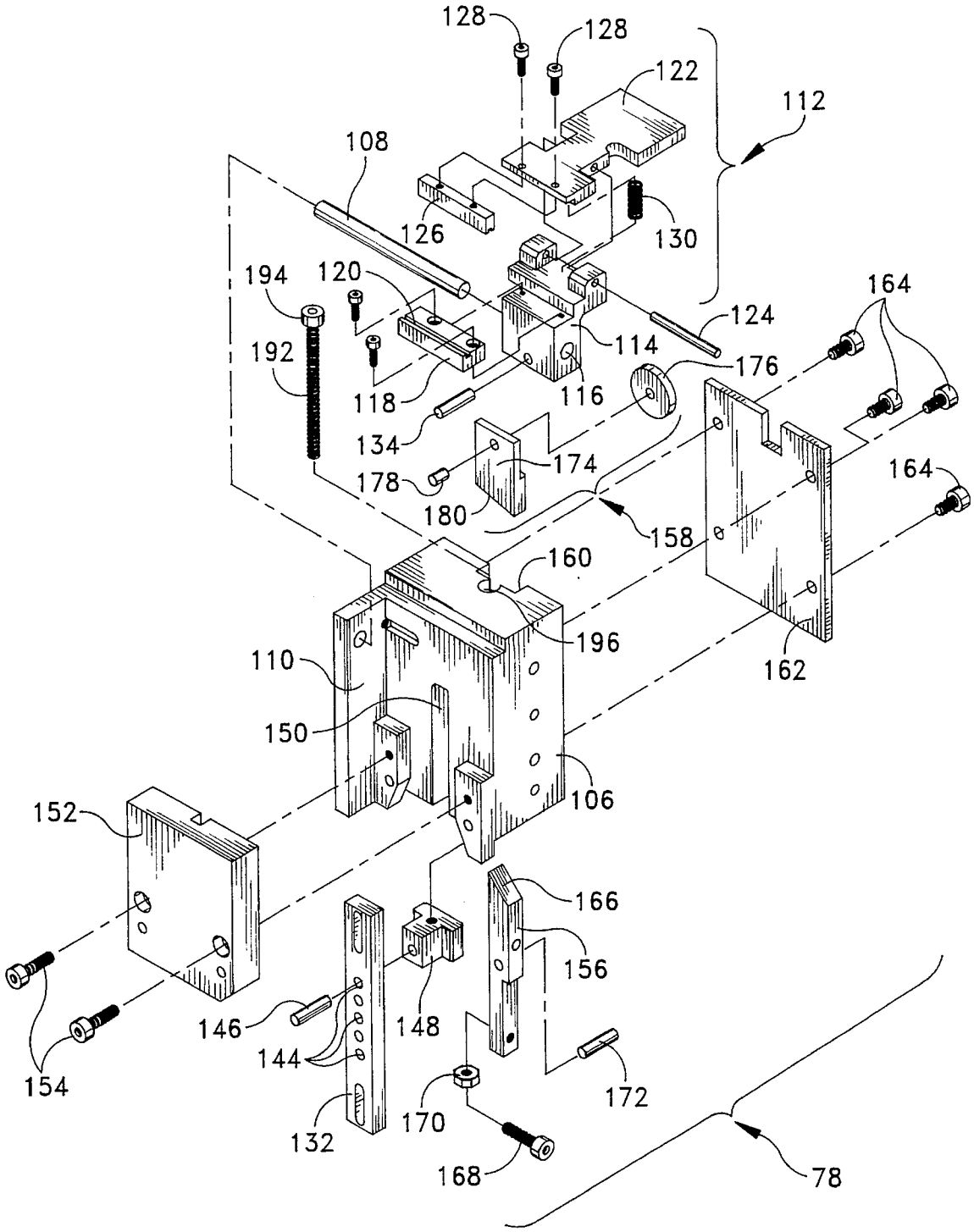
FIG. 8 is an exploded perspective view showing assembly of the feed block assembly and feed clamp assembly.
Figure 9:
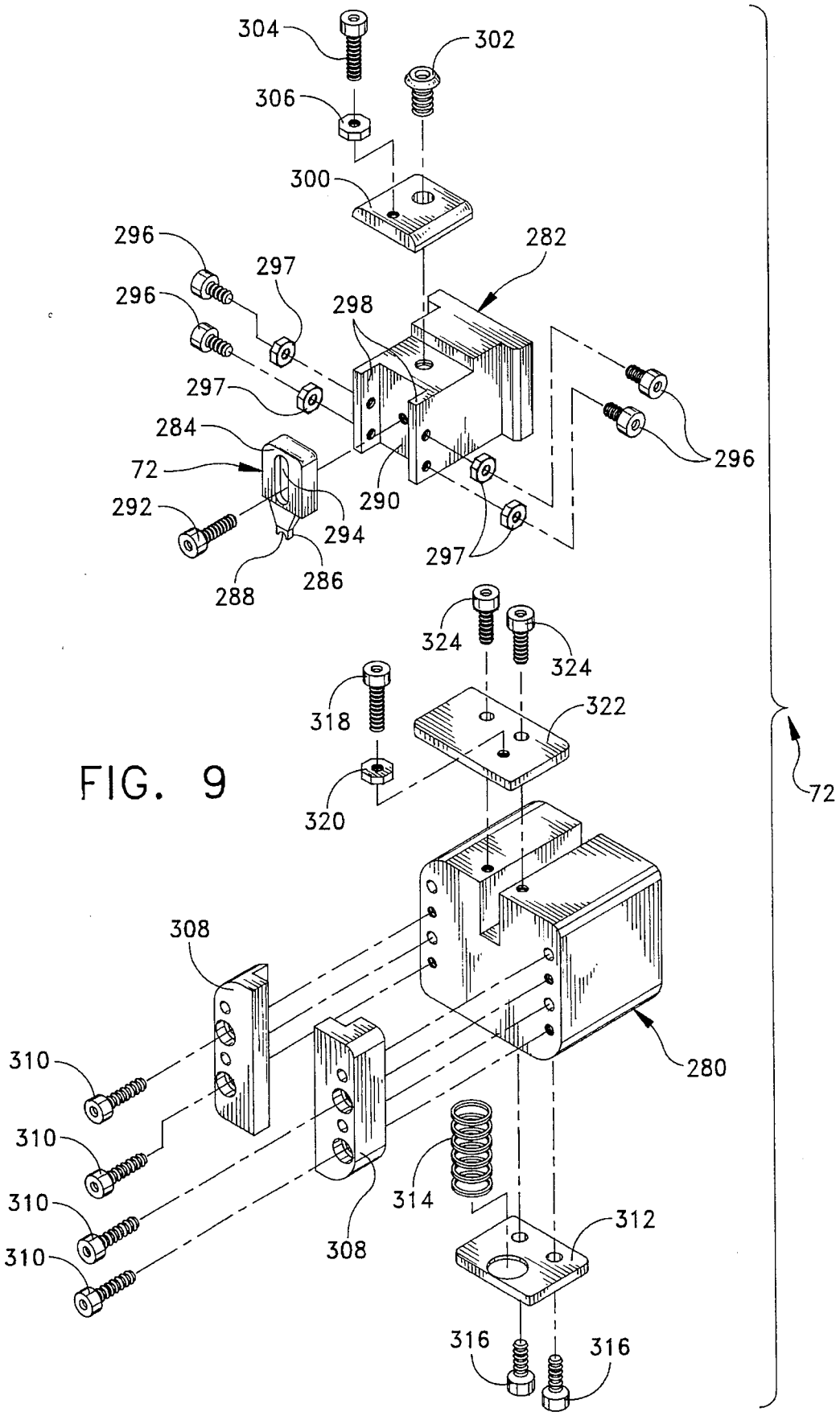
FIG. 9 is an exploded perspective view showing assembly of the head block assembly and die holder.
Figure 10:
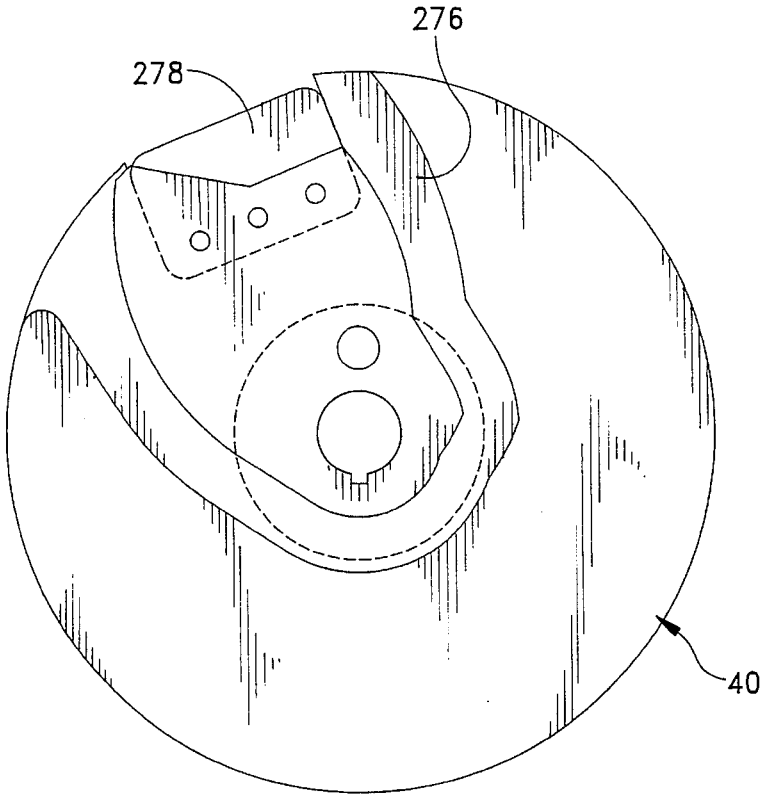
FIG. 10 is a rear view of the first cam showing the groove for receiving the forming tool roller.
Figure 11:
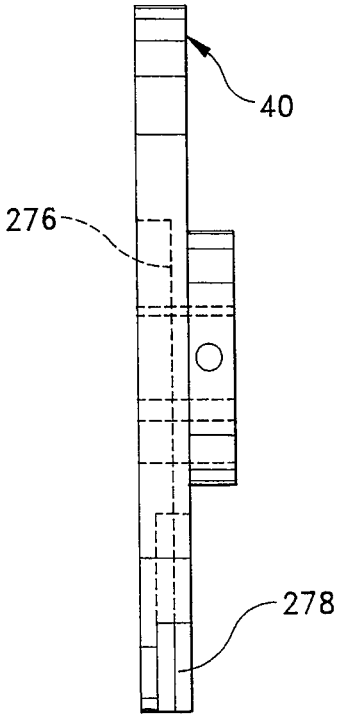
FIG. 11 is a side view thereof.
Figure 12:
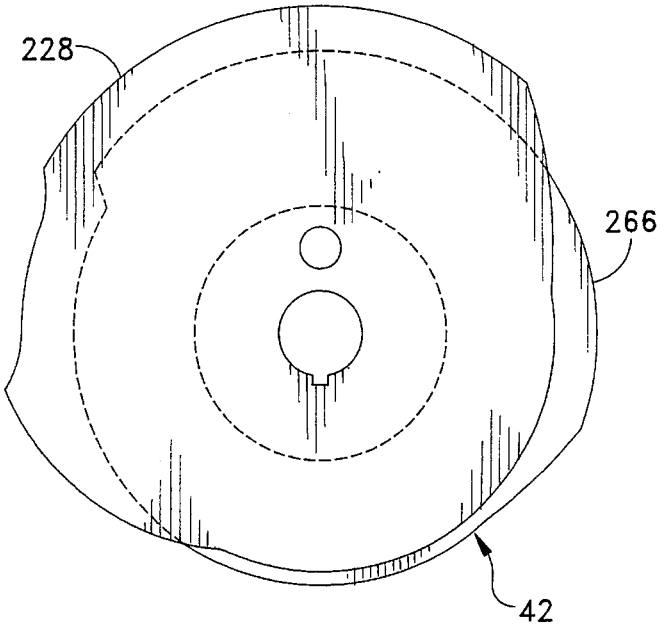
FIG. 12 is a front view of the second cam showing the surface for driving the forming carriage roller.
Figure 13:
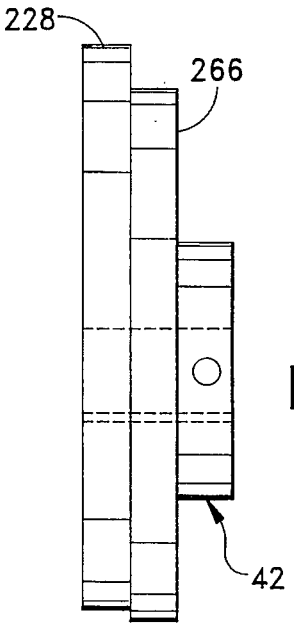
FIG. 13 is a side view thereof.
Figure 14:
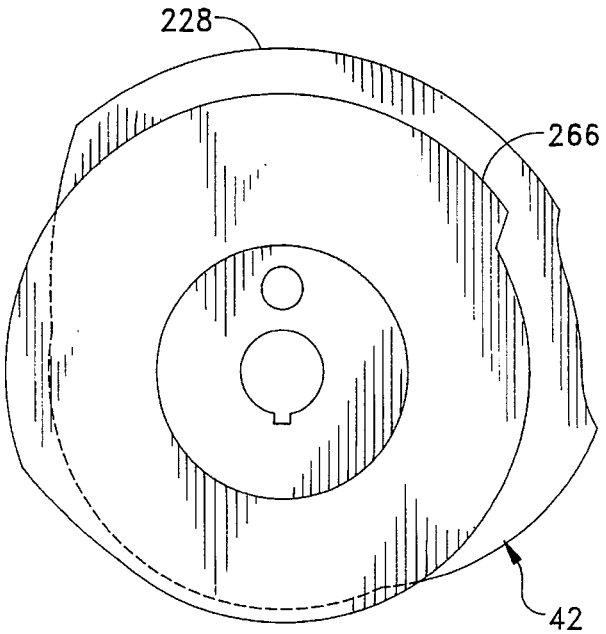
FIG. 14 is a rear view thereof showing the surface for the arbor retraction carriage roller.
Figure 15:
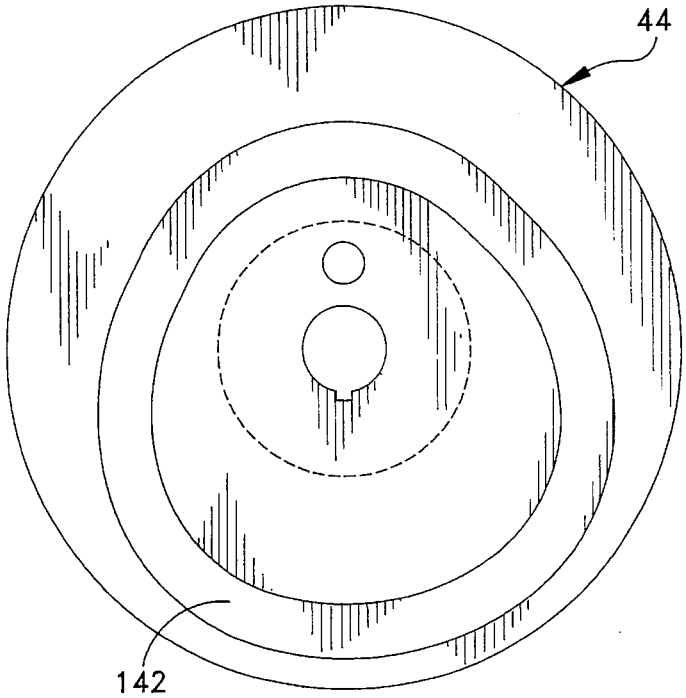
FIG. 15 is a front view of the third cam showing the groove for the feeding arm roller.
Figure 16:
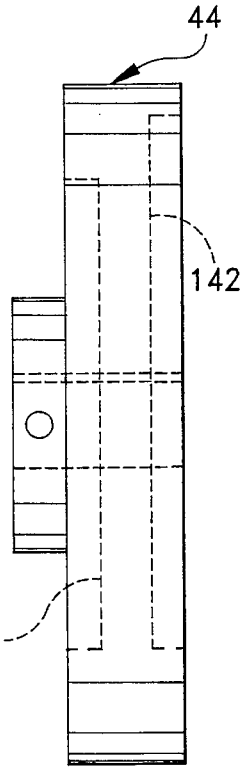
FIG. 16 is a side view thereof.
Figure 17:
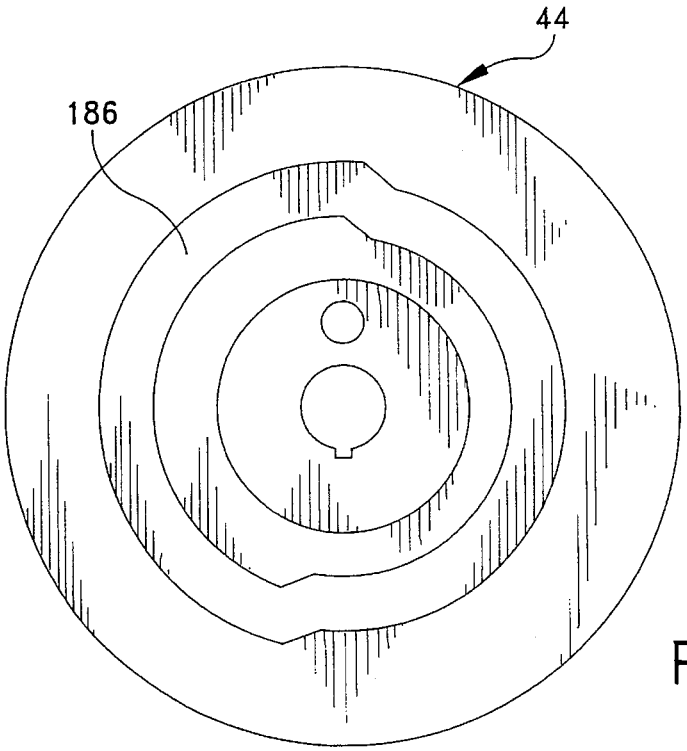
FIG. 17 is a rear view thereof showing the groove for the clamping arm roller.
Figure 18:
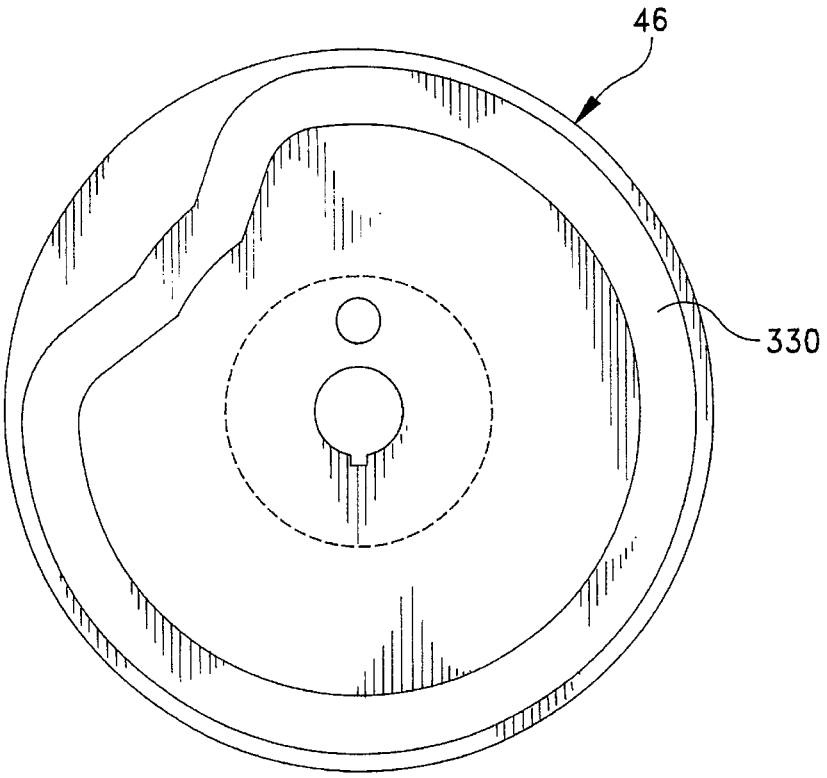
FIG. 18 is a rear view of the fourth cam showing the groove for receiving the forming head roller.
Figure 19:
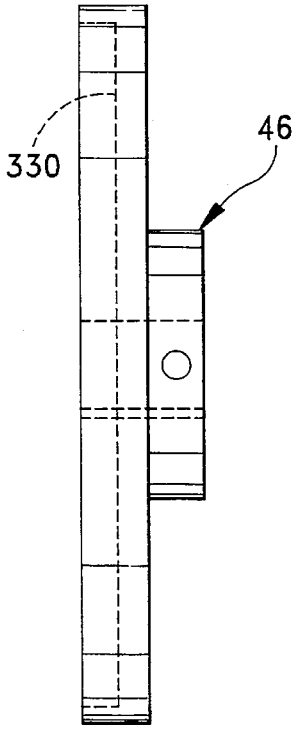
FIG. 19 is a side view thereof.
Figure 20:
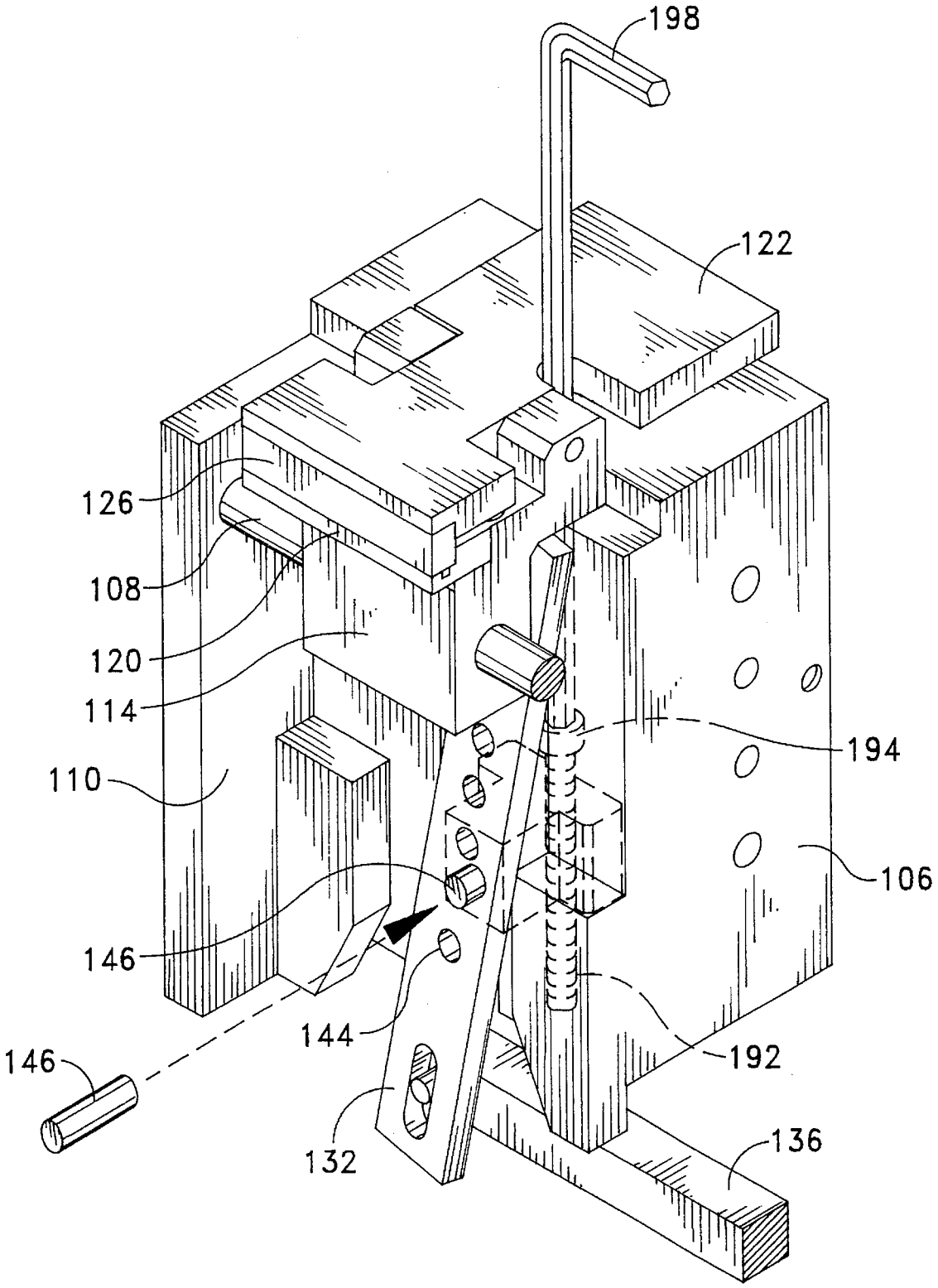
FIG. 20 is an enlarged perspective view of the feed block assembly showing adjustment of the pivot axis of the feed clamp lever.

The feeding apparatus 54 comprises a felt pad carrier assembly 74 (FIG. 7), a brake clamp assembly 76, and a feed block assembly 78 (FIG. 8). Felt pad carrier assembly 74 comprises a tray 80 having notched areas 82 in the front and rear walls thereof. Upper and lower felt pads 84, 86 respectively, are positioned in the tray 80 wherein the wire stock 56 passes between the felt pads 84, 86 for cleaning thereof as wire stock 56 is pulled therethrough. A cotter pin 87 is utilized to maintain the pad 84, 86 in the tray. Tray 80 is attached to the brake clamp assembly 76 by a threaded fastener 88 which passes through tray and a spacing block 90. Brake clamp assembly 76 comprises a body portion 92, a brake insert 94 which is assembled with the body portion 92 as illustrated in the FIG. 7. Brake insert 94 includes a groove 96 for receiving wire stock 56. Insert 94 is biased upwardly against body portion 92 by a brake lever 98 pivotably mounted to the body portion 92 by dowel 100. Brake lever 98 is biased upwardly by spring 102. Brake clamp assembly 76 is secured to a body portion of feed block assembly 78 by a threaded fastener 104. Feed block assembly 78 comprises a body portion 106, a horizontally extending guide bar 108 which extends between a side wall 110 of the body portion 106 and side wall of housing module, and a feed clamp assembly 112 slidably mounted on the guide bar 108. Feed clamp assembly 112 comprises a body portion 114 having a bore 116 therein for slidably receiving guide bar 108, a clamp insert 118 having a groove 120 for receiving wire stock 56, a head portion 122 pivotably mounted to the body portion 114 by a dowel 124, and a head insert 126. Clamp insert 118 and head insert 126 are respectively secured to body portion 114 and head portion 122 by fasteners 128. Head portion 122 is positioned for pivoting movement wherein head insert 126 engages clamp insert 118 for grasping wire stock 56 resting in groove 120. Head portion 122 is biased into engagement with clamp insert 118 by spring 130. In operation, the feed clamp assembly 112 is actuated along guide bar 108 between first and second positions (not 24 illustrated) by means of a lever 132 pivotably mounted at a first end to body portion 114 by pivot pin, and pivotably mounted at a second end to a cam driven actuator arm 136 by a pin 138. Actuator arm 136 extends into the housing module and includes a pin mounted roller 140 which is received in a groove 142 on the front surface of cam 44. Lever 132 includes a plurality of apertures 144 for receiving a pivot pin 146 of a pivot block 148 slidably received in channel 150 formed in the body portion 106 (See FIGS. 20–21). Pivot pin 146 is received through one of the apertures 144 in the lever 132 to define a pivot axis of the lever 132. As the actuator arm 136 is driven inwardly and outwardly by cam 44, the lever 132 pivots on the pivot pin 146 to move the feed clamp assembly 112 between first and second positions. A cover plate 152 is secured to the front surface of the feed block body 106 by fasteners 154 to maintain the lever 132 in position.

The clamping head 122 is pivotably actuated by means of a lever 156 and follower 158 mounted in a channel 160 on the rear surface of the feed block body 106. A cover 162 is secured over the channel 160 by fasteners 164 to maintain the lever 156 and follower 158 in position. The upper end of the lever 156 is tapered to form a wedge 166 and the lower end is provided with a threaded screw 168 and lock nut 170. The center portion of the lever 156 is pivotably mounted to feed block body 106 by a dowel 172. Lever follower 158 comprises a body portion 174 and a roller rotatably mounted to body portion 174 by a pin 178. The lower edge 180 of the follower body 174 is tapered to a wedge corresponding with the wedge-shaped upper end 166 of the lever 156. The tapered edge 180 of the follower body 174 rests on top of the tapered end 166 of the lever 156. Lever 156 is actuated by an horizontal actuator arm 182 which extends into housing module. Actuator arm 182 includes a roller 184 which is received in a groove 186 in the rear surface of cam 44. As the actuator arm 182 moves inwardly and outwardly, the lever 156 pivots to move the follower 158 upwardly and downwardly to engage the rear end of head portion 122 of the feed clamp assembly 112 and to thereby press the feed insert 118 into engagement with the wire stock 56. Referring to FIG. 5, the actuator arms 136 and 182 are held in position by two interengaging guide bodies 188 which are received in an opening 190 formed in the left hand side wall 14 of the housing module.

In operation of the feed mechanism, the grooves 142 and 186 in the front and rear surface of cam 44 are contoured to provide movement of the clamp and feed mechanisms in timed relation. In this connection, the feed clamp assembly 112 is normally situated to a far left position with the clamp head 122 resting in an unclamped state. The actuator arms 136,182 are cam driven to provide sequential clamping of the clamp head 122 and movement of the feed clamp assembly 112 to the right to feed a section of wire stock 56 into the cutting and bending station 58, and then to provide release of the clamp head 122 to release the wire stock 56 and movement of the feed clamp assembly 112 back toward the left. When the feed clamp assembly 112 is actuated from the first position to the second position with the clamp head 122 in engagement, the rear end of clamp head 122 rolls on the follower roller 176, thus preventing displacement of the assembly due to friction. The brake clamp assembly 76 prevents the wire stock from being retracted as the feed clamp assembly 112 moves back to the left.

One important aspect of the feed block assembly 78 is that the pivot axis of the feed clamp lever 132 is easily adjustable to alter the length of wire section 62 fed into the cutting and bending station 58. In this regard, the vertical position of the pivot block 148, and thus, the pivot axis of the lever 132, is adjustable by changing which aperture 144 the pivot pin 146 extends through. Furthermore, finite adjustments of the pivot axis position is accomplished by a threaded rod 192 extending downwardly through a threaded bore in the pivot block 148. An allen type head portion 194 of the threaded rod 192 is accessible through a bore 196 in the top of the body portion 106, wherein the rod 192 is rotatable by means of an allen type wrench 198 (see FIG. 20).

Figure 21:
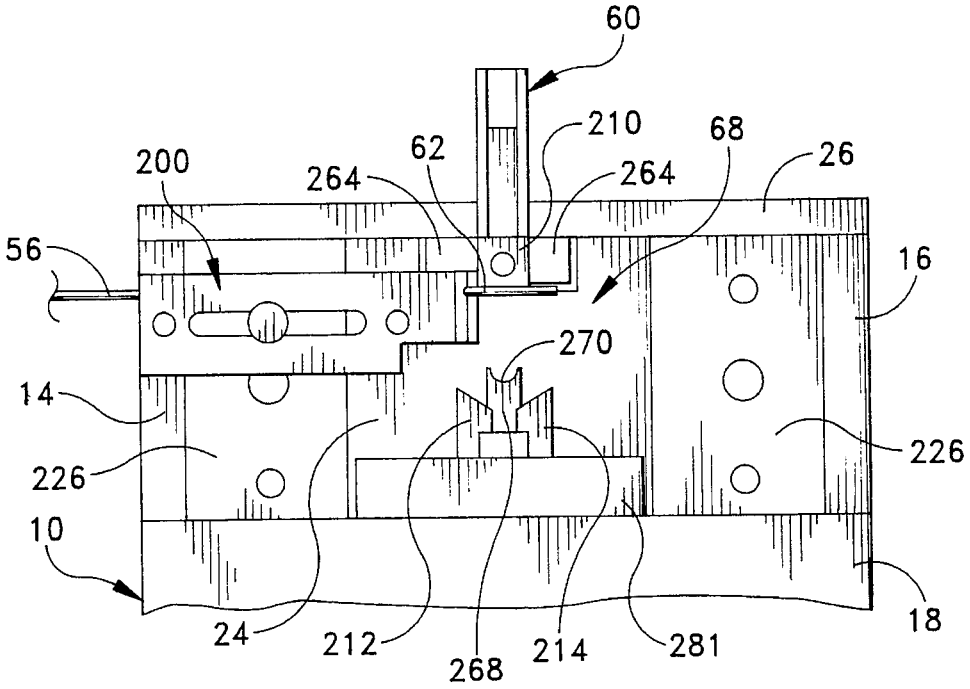
FIG. 21 is a fragmentary front view of the link forming apparatus showing the wire section positioned in the cutting and bending station.
Figure 22:
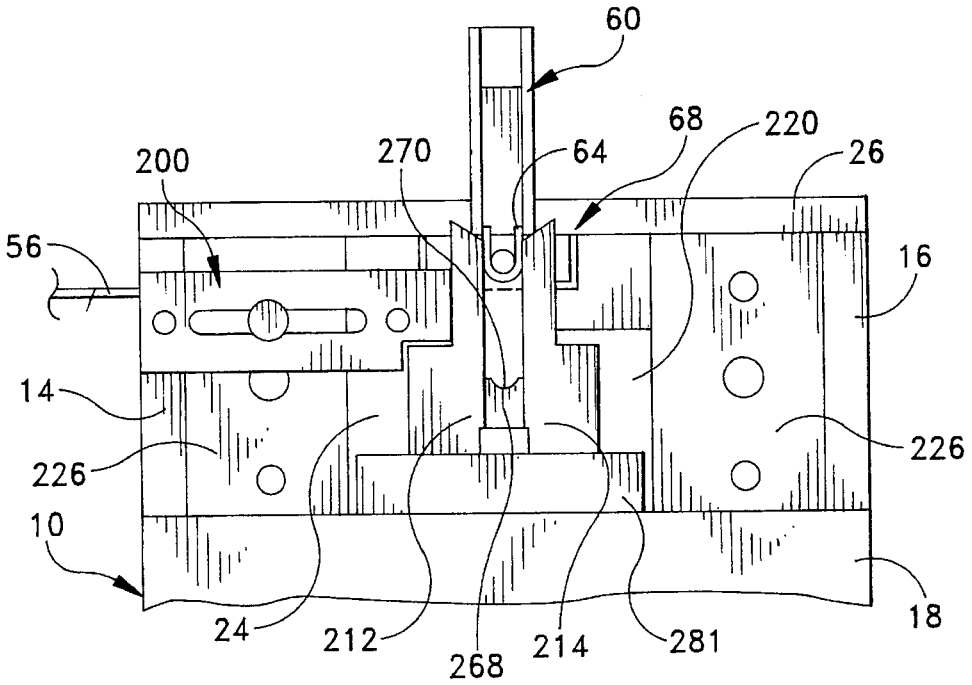
FIG. 22 is another fragmentary front view thereof showing the forming blades moved upwardly to bend the wire element around the arbor.
Figure 23:
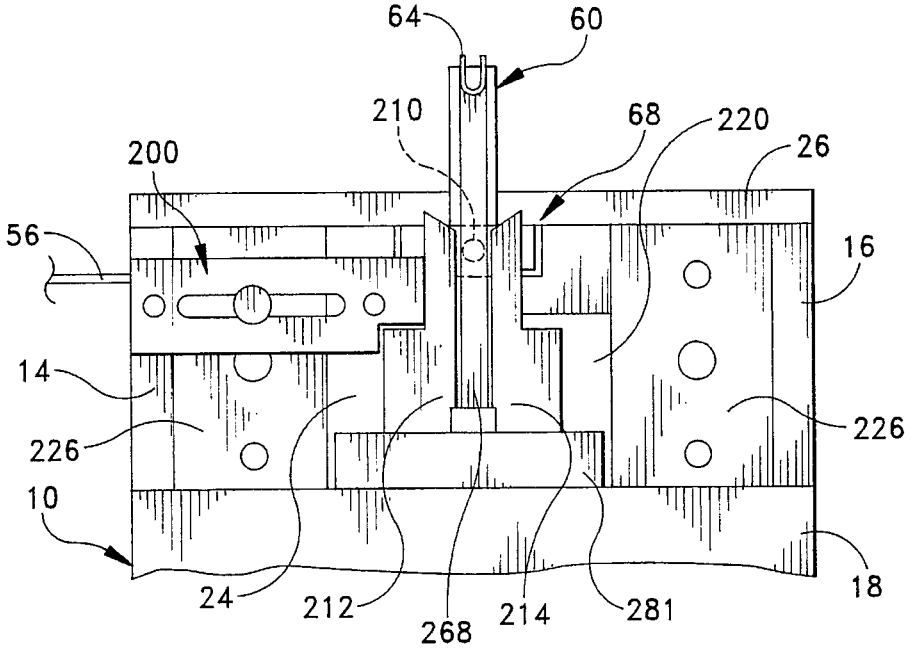
FIG. 23 is yet another fragmentary front view showing the lower forming tool pushing the U-shaped element upwardly through the guide assembly to the closure station.

Referring now to FIGS. 21–23, a wire section 62 is situated in the cutting and bending station 58 awaiting cutting and bending actions by cutting means and bending means. As wire stock 56 enters the housing module, it passes through a guide block 200 having a bore 202 formed therein. More specifically, the guide block 200 comprises two guide plates 204, 206 with grooves 207 which are secured together and attached to the housing module by a fastener 208. As illustrated in FIGS. 21, the wire section 62 extending from the guide block 200 is situated between an arbor 210 and a pair of forming arms 212, 214 which are carried by a forming carriage 216. The arbor 210 is most clearly illustrated in FIG. 4. The arbor 210 is slidably mounted in a seat 211 which secured in a notch 213 in support block 24, and is normally biased to an outward position by a spring 218. Seat 211 is secured by a fastener 215. Spring 218 is received in a bore 219. Severing of the wire section 62 from the wire stock 56 and bending of the wire section 62 into a U-shaped wire element 64 are accomplished in a single step by vertical movement of the forming carriage 216. Forming carriage 216 comprises a carriage body 220, forming 212,214 mounted to the body 220, and a roller 222. The forming carriage is slidably received adjacent the front of the housing module in a pair of guide slots 224 formed by guide blocks 226. Guide blocks 226 are secured to support block 24 by fasteners 227 When mounted in the guide slots 224, the roller 222 rests on top of the front cam surface 228 of cam 42 which is operative for driving the vertical movement of the forming carriage 216. As illustrated in FIG. 21, the forming carriage 216 is normally situated in a dwell position. However, after the wire section 62 is fed into the cutting and bending station 58, the carriage 216 is driven upwardly by the cam 42 wherein the left-hand forming arm 212 passes in closely spaced relation with the terminal edge of the guide block 200. The forming arm 212 and guide block 200 cooperate to sever the wire section 62 from the wire stock 56. In this connection, it is pointed out that the confronting edges of the guide block 200 and the forming arm 212 are tapered to form an angled cut of the wire 62. In this manner, when the ends of the wire section are closed, they form an overlapping junction. The forming arms 212, 214 are then driven further upwardly with the arms passing on opposing sides of the arbor 210 wherein the wire section 62 is bent around the arbor 210 to form the U-shaped wire element 64. The upper edges of the forming arms 212,214 include grooves 230 which hold the wire section 62 during the severing and bending step. Since the carriage roller 222 only rides on the surface of the cam 42, the carriage is further provided with return springs 232 to force the carriage 216 downwardly and maintain the roller 222 in contact with the cam surface 228 during complete rotation of the cam 42. The springs 232 are held in position by posts 234 on the carriage body 220 and are captured underneath the top plate 26 of the housing module.

Figure 24:
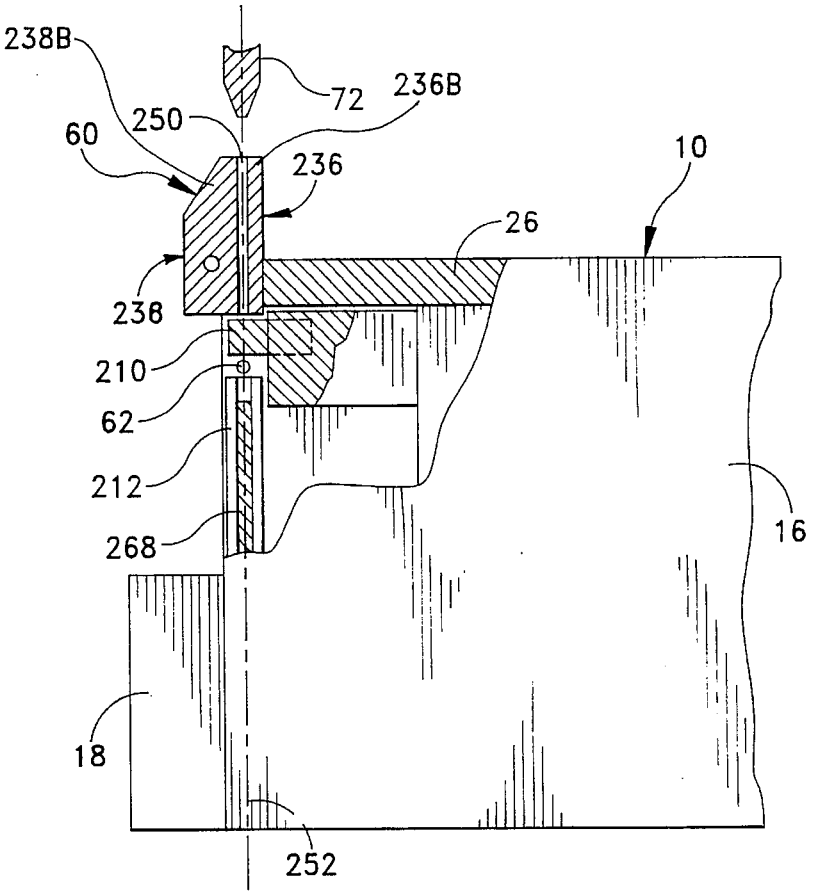
FIG. 24 is a partial cross-sectional view taken along lines 24—24 of FIG. 2 showing the working plane in which the wire element is severed, bent and formed.

After the U-shaped wire element 64 is formed it must be moved upwardly into guide assembly 60 which is situated directly above the arbor 210. The guide assembly 60 comprises a guide body 236 which is mounted in a notch 237 in the front edge of top plate 26 of the housing module, and a guide pinch 238 which is pivotably mounted to the guide body 236 by a dowel 240. The guide body 236 includes a guide surface 236A while the guide pinch 238 includes a guide surface 238A (see FIG. 3). The guide body 236 is secured by a fastener 241. The guide pinch 238 is biased to a pinching position by means of a spring 242 and pin 244 mounted in the pinch 238. When the pinch 238 is mounted in position, the pin 244 extends downwardly to make contact with the surface of the insert tooling cover 34. Pinching pressure is adjusted by rotation of a threaded set screw 246 mounted in the spring bore 248. The guide assembly 60 defines a vertical passage 250 (FIG. 24 having a bottom end immediately adjacent the arbor 210, and a top end where the U-shaped wire element 64 is held for joining and closure by the forming head assembly 70. The guide passage effectively forming a working plane (indicated by broken lines 252 in FIG. 24) in which the wire element 62 is severed, bent and formed into a completed ring. In order to move the formed wire element 64 upwardly, the arbor 210 must be retracted out of the working plane 252. Retraction of the arbor 210 is accomplished by a retraction carriage 254 which is received in guide slots 256 in the rear portion of guide blocks 226 in back of the forming carriage 216. Retraction carriage 254 comprises a body portion 258, two upwardly extending spaced tapered fingers, 260 and a roller 262 mounted on the bottom edge of the body portion 258 by pin 263. The tapered fingers 260 are oriented for engagement with corresponding tapered surfaces 264 on the arbor body. When mounted in the guide slots 256, the roller 262 rests on top of the back cam surface 266 of cam 42 which is operative for driving the vertical movement of the retraction carriage 254. The retraction carriage 254 is normally situated in a dwell position. However, after the wire section 62 is formed into the U-shaped wire element 64, the carriage 254 is driven upwardly by the cam 42 wherein the tapered fingers 260 engage the tapered surfaces 264 of the arbor 210 and push the arbor 210 rearwardly out of the working plane 252. Since the carriage roller 262 only rides on the surface of the cam 42, the carriage is further provided with return springs 268 to force the carriage 254 downwardly and maintain the roller 262 in contact with the cam surface 266 during complete rotation of the cam 42. The springs 267 are held in position by posts 269 on the carriage body 254 and are captured underneath the top plate 26 of the housing module.

The formed wire element 64 is then moved upwardly in the guide passage 250 by means of a lower forming tool assembly 66. Lower forming tool assembly 66 comprises an elongate forming tool 268 having a curved edge 270 at the upper end thereof. The lower end of the tool 268 is attached to a block 272 which has a roller 274 mounted to the bottom edge thereof. Vertical movement of the forming tool assembly 66 is guided by grooved passage 275 in the front wall 18 which receives tool block 272, and further, is driven by cam 40 received in a recess 277 formed in the front wall 18. Roller 274 is received in a groove 276 formed in the rear surface of cam 40. Cam 40 is provided with an insert 278 which determines the upper limit of movement of the forming tool assembly 66. The tool 268 extends upwardly between the forming arms 212, 214 and into ring guide passage 250. Accordingly, after the arbor 210 is retracted, the lower forming tool 268 is driven upwardly by cam 40, wherein the curved edge 270 thereof engages the bottom of the U-shaped element 64 and pushes the element 64 upwardly through the guide passage 250. The wire element 64 is then maintained at the upper end of the passage 250, i.e. the forming station, by means of the forming tool 260 and by means of the guide pinch 238. In this regard, the upper end portion 238B of the guide pinch 238 is pivotably movable between a first position (FIG. 1) wherein the upper end portion 238B engages an upper end portion 236B of the guide body 236, and a second position (FIG. 24) wherein the upper end portion 238B is spaced from the guide body 236. Since the groove 276 is open at the insert, the forming tool block 272 is biased downwardly by a spring 279 held in place by spring return cap 281.

Closure of the wire element 64 is accomplished by downward movement of forming head die 72. Forming head die 72 is mounted in forming head assembly 70 which comprises a head block 280, and a die holder 282. The forming head die 72 includes a body portion 284 and a downwardly extending die portion 286 having-a curved forming edge 288 thereon. The forming head die 72 is mounted in a channel 290 in the front of the die holder 282 by means of a threaded fastener 292 which extends through an enlarged slotted opening 294 in the body portion thereof. Horizontal positioning of the forming head die 72 is adjusted by means of threaded set screws 296 and nuts 297 extending through the channel walls 298. A cap 300 is mounted on the top of the die holder 282 by a threaded fastener 302, and vertical positioning of the forming head die 72 is adjusted by means of a set screw 304 and nut 306 extending through the cap 300. Holder elements 308 are secured to the front of the head block 280 by fasteners 310. The die holder 282 is slidably received in a channel formed at the front of the head block by the two holder elements 308. Downward movement of the die holder 282 is restrained by a plate 312 and spring 314 assembly mounted to the bottom of the head block 280 by fasteners 316. In this connection, the spring 314 normally biases the die holder 282 to an upwardly disposed position. Upward movement of the die holder 282 is restrained by a set screw and nut 320 mounted in a plate 322 secured to the top of the head block 280 by fasteners 324. The head block 280 is mounted to the top portion of the head block support plate 22 of the housing module. In this connection, the head block 280 remains stationary, while the die holder 282, and forming head die 72 are permitted to slide vertically with respect to the head block 280. Downward movement of the die holder 282 is accomplished by an L-shaped actuator 326 driven by cam 44. A roller 328 mounted to the bottom end of the vertical leg of the actuator 326 rides in a groove 330 formed in the back surface of cam 44 for movement of the actuator 326. The vertical leg extends upwardly out of the housing module through an notch 332 in the rear edge in the top plate 26. The horizontal leg extends forwardly into a groove 334 formed in the top of the head block 280, wherein the forwardmost end of the horizontal leg engages the top of the die holder 282. Accordingly, downward movement of actuator 326 forces the die holder 282 downwardly in the groove 334 against the bias of spring 314 wherein the forming head die 74 engages the U-shaped wire element 64 for closure thereof. Actually, the downward movement of the forming head die 72 does not completely close the open end of the wire element 64. The forming head die 72 is maintained is a slightly spaced relation from the guide assembly 60 so that the forming head die 72 and guide assembly 60 do not impact. When the forming head die 72 is in the lowered position, a ridge on cam 40 drives the lower forming tool 268 slightly upwardly so that the partially closed link is driven upwardly into the forming head die 72. The formed link remains in the guide assembly 60 while the cam shaft 38 completes a full revolution. The formed link is thereafter ejected from the guide assembly 60 by the next U-shaped element 64 passing upward through the guide assembly 60.

It can therefore be seen that the instant invention provides an effective and novel link forming apparatus 10 which overcomes the drawbacks of the prior art devices. As seen in the illustrations, the cutting and forming tools are easily accessible thorough removal of the cover assemblies and top plate of the housing module for changing of tooling inserts. It can further be seen that when the wire stock is changed, the length of the wire section fed into the cutting and bending station is easily adjustable by means of the improved feed assembly disclosed herein. Most importantly, the apparatus effectively forms and closes a single link without the need for storing a plurality of links in a magazine, thereby eliminating unused wire elements when switching wire stock. The single link forming method is accomplished by cutting, bending and closing the link within a common working plane. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. Apparatus for forming a wire link and joining the wire link as formed to a preformed jewelry article comprising:

a guide assembly including a vertically extending passage therein, said passage having a lower end for receiving a U-shaped wire element therein with an open end of said U-shaped wire element facing upwardly, said passage further having an upper end defining a forming station, said passage defining a working plane;

a lower forming tool mounted for sliding movement in said passage for engaging said U-shaped wire element in said passage and lifting said U-shaped wire element from said lower end of said passage to said forming station at said upper end;

a head assembly located above said guide assembly, said head assembly including a forming head die mounted for vertical movement within said working plane for engaging said U-shaped wire element during a forming operation, said forming head die cooperating with said lower forming tool to form said U-shaped wire element into a completed link during said forming operation;

means for feeding wire stock to a cutting and bending station located within said working plane at the lower end of said passage, said feeding means including means for adjusting the length of a wire section severed from said wire stock, said means for feeding said wire stock comprising a feed block assembly and a feed clamp assembly mounted on said feed block assembly, said feed block assembly comprising a body portion, and a horizontally extending guide bar mounted to said body portion, said feed clamp assembly being slidably mounted on said guide bar for movement between first and second positions, said feed clamp assembly receiving a length of wire stock therethrough and including means for selectively clamping said wire stock, said feed block assembly further comprising a pivotably mounted lever having a first end pivotably mounted to said feed clamp assembly and a second end coupled to an actuator arm of said link forming apparatus, said actuator arm being movable for actuating said feed clamp assembly between said first and second positions, said lever including a plurality of apertures therein, said feed block assembly further comprising a pivot block slidably mounted in said body portion, said pivot block having a pivot pin extending therefrom, said pivot pin defining a pivot axis of said lever, said pivot pin being selectively extended through one of said apertures in said lever to adjust the vertical position of said pivot axis, said pivot block being slidably adjustable within said body portion by means of a threaded rod extending vertically through said pivot block for finite adjustment of said vertical position of said pivot axis;

means at said cutting and bending station for severing a wire section from said wire stock;

means at said cutting and bending station for bending said wire section into a U-shaped wire element within said working plane; and means for operating said feeding means, said severing means, said bending means, said lower forming tool and said forming head die in timed relation to sequentially severing a single wire section, bending said wire section into a U-shaped wire element and forming said U-shaped wire element into a closed link.

2. In a link forming and joining apparatus of the type comprising upper and lower die assemblies for engaging a U-shaped wire element in a linking operation, and means for feeding a wire stock into a cutting and bending station for forming said U-shaped wire element, the improvement comprising means for adjusting the length of a wire section severed from said wire stock, said means for feeding said wire stock comprising a feed block assembly and a feed clamp assembly mounted on said feed block assembly, said feed block assembly comprising a body portion, and a horizontally extending guide bar mounted to said body portion, said feed clamp assembly being slidably mounted on said guide bar for movement between first and second positions, said feed clamp assembly receiving a length of wire stock therethrough and including means for selectively clamping said wire stock, said feed block assembly further comprising a pivotably mounted lever having a first end pivotably mounted to said feed clamp assembly and a second end coupled to an actuator arm of said link forming apparatus, said actuator arm being movable for actuating said feed clamp assembly between said first and second positions, said lever including a plurality of apertures therein, said feed block assembly further comprising a pivot block slidably mounted in said body portion, said pivot block having a pivot pin extending therefrom, said pivot pin defining a pivot axis of said lever, said pivot pin being selectively extended through one of said apertures in said lever to adjust the vertical position of said pivot axis, said pivot block being slidably adjustable within said body portion by means of a threaded rod extending vertically through said pivot block for finite adjustment of said vertical position of said pivot axis.

3. A forming station for a link forming and joining apparatus comprising:

a pinch assembly for receiving and holding said U-shaped element during forming, said pinch assembly comprising a guide body and a guide pinch, said guide pinch being pivotally connected to said guide body at a central point thereof wherein a guide surface of said guide pinch is positioned in closely spaced facing relation to a guide surface of said guide body to define a guide passage having upper and lower ends, said guide pinch having an upper end portion which is pivotably movable between a first position wherein said upper end portion engages an upper end portion of said guide body, and a second position wherein said upper end portion is spaced from said guide body;

means for normally biasing said guide pinch to said first position; and means for advancing said U-shaped element from said lower end of said guide passage to said upper end thereof wherein said U-shaped element is pinched between said guide pinch and said guide body and held for forming.

4. The forming station of claim 3 wherein said means for biasing comprises spring means captured between a lower end portion of said guide pinch and a frame portion of said apparatus.

5. The forming station of claim 4 further comprising means for adjusting a pinching pressure of said guide pinch.

* * * * *